US005372025A

United States Patent [19]

Lin

[11] Patent Number: 5,372,025

[45] Date of Patent: Dec. 13, 1994

[54] OUTER HANDLE OF A DOOR LOCK

[76] Inventor: Jui-Chang Lin, No. 297, Bor-Ay Road, Kaohsiung, Taiwan, Prov. of China

[21] Appl. No.: 46,738

[22] Filed: Apr. 15, 1993

[51] Int. Cl.[5] ..... E05B 55/06

[52] U.S. Cl. ..... 70/472; 70/149; 70/223; 70/477; 70/478; 292/DIG. 27

[58] Field of Search ..... 70/218, 221–224, 70/472, 149, 473–475, 477, 478, 483–485; 292/359, DIG. 27

[56] References Cited

U.S. PATENT DOCUMENTS

| | | | |
|---|---|---|---|
| 1,714,286 | 5/1929 | Waldo | 292/DIG. 27 X |
| 3,800,573 | 4/1974 | Babb, Jr. et al. | 292/359 X |
| 4,470,278 | 9/1984 | Hale et al. | 292/359 X |
| 4,470,279 | 9/1984 | Neary et al. | 292/359 X |
| 4,966,399 | 10/1990 | Lin | 292/359 |
| 5,010,752 | 4/1991 | Lin | 70/472 X |
| 5,074,607 | 12/1991 | Lin | 292/359 |

*Primary Examiner*—Lloyd A. Gall

*Attorney, Agent, or Firm*—Jacobson, Price, Holman & Stern

[57] ABSTRACT

An outer handle of a door lock includes a tube extended inward of the door, a lock disposed in the tube, a stub fixed on one end of a shaft and having a square section and a circular section, a cylinder rotatably received in the tube and coupled to the lock and including two pairs of notches of different depth, a board engaged with either of the sections. The shaft can be rotated by the outer handle when the board is engaged with the square section of the stub and can not be rotated when the board is engaged with the circular section. The stub can be rotated by the shaft when the board is engaged with either of the sections.

6 Claims, 4 Drawing Sheets

OUTER HANDLE OF A DOOR LOCK

BACKGROUND OF THE INVENTION (a) Field of the Invention

The present invention relates to a door lock, and more particularly to an outer handle of a door lock.

(b) Description of the Prior Art

A typical door lock is disclosed in U.S. Pat. No. 5,074,607 to Lin, entitled "LOCK SET WITH SPINDLE LOCK", issued, Dec. 24, 1991. However, normally, the door locks includes a knob which can not be operated before a latch mechanism is released such that the handicapped persons can not operate such door locks easily.

The present invention has arisen to mitigate and/or obviate the afore-described disadvantages of the conventional door locks.

SUMMARY OF THE INVENTION

The primary objective of the present invention is to provide a door lock in which the door lock can be easily operated by the handicapped persons.

In accordance with one aspect of the present invention, there is provided a door lock comprising an inner handle and an outer handle assembly, the outer handle assembly comprising a bowl including an opening formed therein, a cap engaged to the bowl, a tube rotatably engaged in the cap and including a free end having a pair of lugs formed therein, an outer handle fixed to the tube, a lock engaged in the tube and including a protrusion extended therefrom, a cylinder rotatably engaged in the tube and including a first end and a second end, the protrusion of the lock being engaged with the first end of the cylinder in order to rotate the cylinder, the second end of the cylinder including two pairs of notches formed therein, a first pair of the two pairs of notches including a depth deeper than that of a second pair of notches, a shaft of square cross section including a first end coupled to the inner handle and a stub fixed to a second end thereof, the stub including an intermediate section having a square cross section and a circular outer section, a board engaged with either pair of the notches and including a square hole formed therein for engaging with either of the intermediate section or the circular outer section, means biased between the stub and the board, a lever extended through the shaft and including a first disc fixed to a first end thereof and engaged in the cylinder, a second disc rotatably engaged on the shaft and including a pair of slots formed therein for engaging with the lugs of the tube, a barrel engaged on the shaft and including a first end contacted with the second disc, the board being engaged with the intermediate section of the stub when the board is engaged with the second pair of notches such that the shaft and the stub is rotated by the outer handle, and the board being biased to engage with the first pair of notches by the biasing means when the cylinder is rotated by the protrusion of the lock such that the board is rotated freely relative to the stub, the stub being rotated by the shaft and the inner handle.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
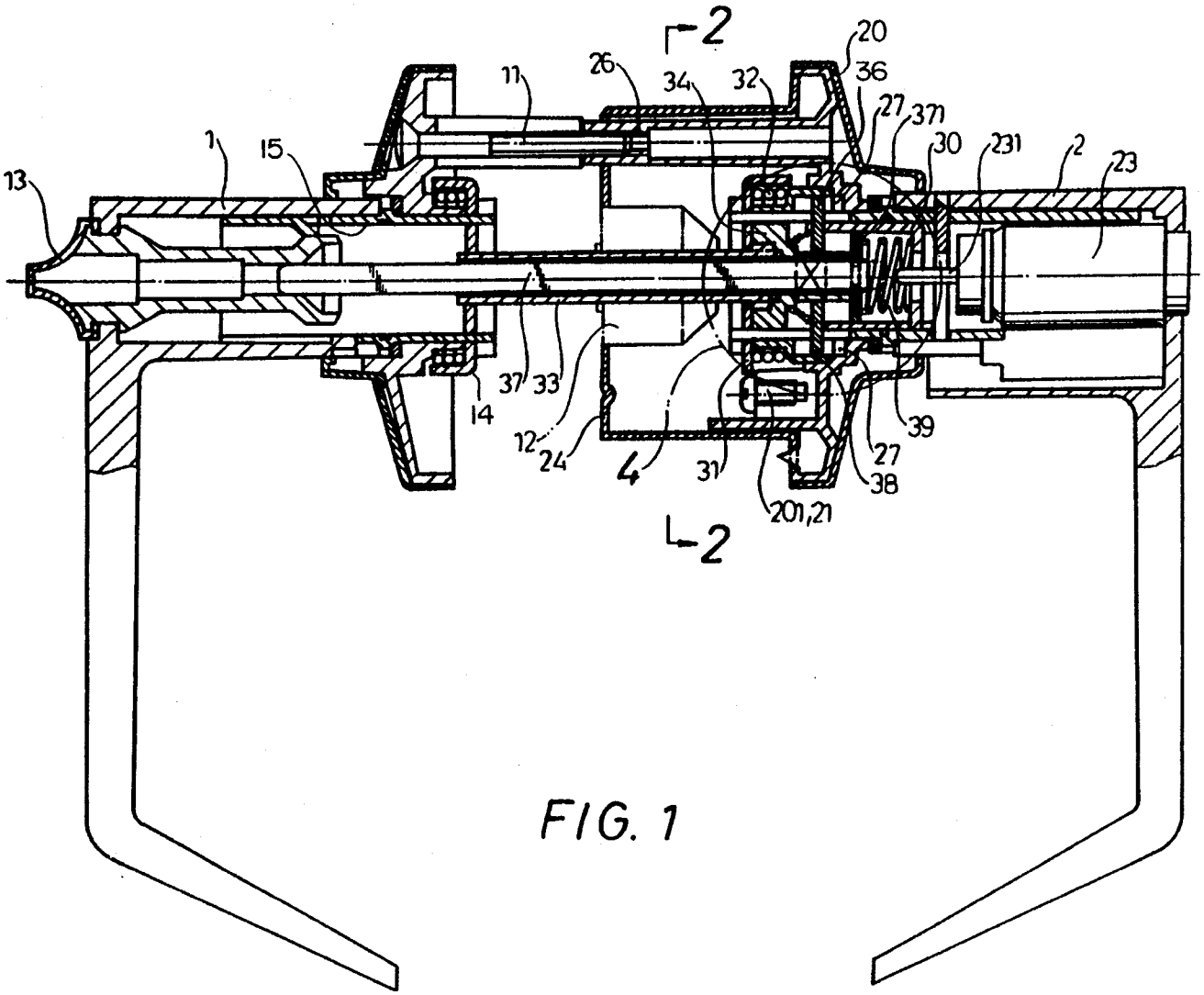
FIG. 1 is a cross sectional view taken along lines 1—1 of FIG. 2, illustrating a door lock in accordance with the present invention.
Figure 2:
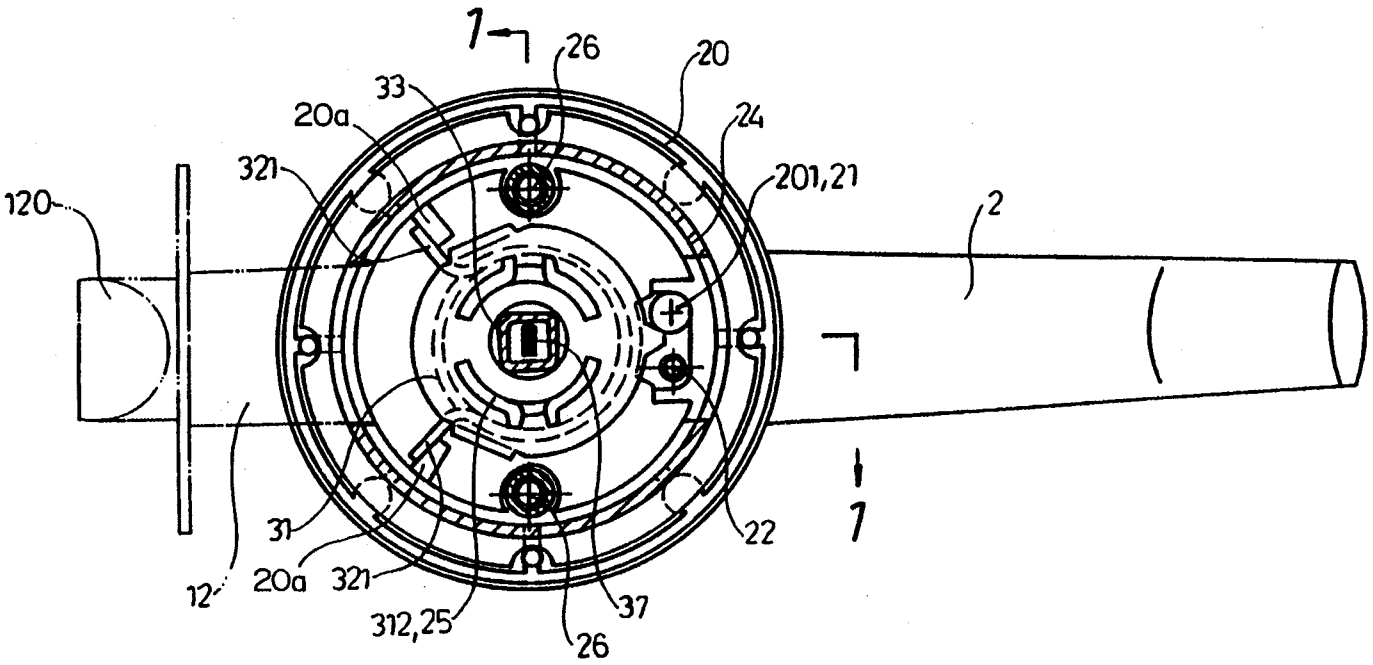
FIG. 2 is a cross sectional view taken along lines 2—2 of FIG. 1.
Figure 3:
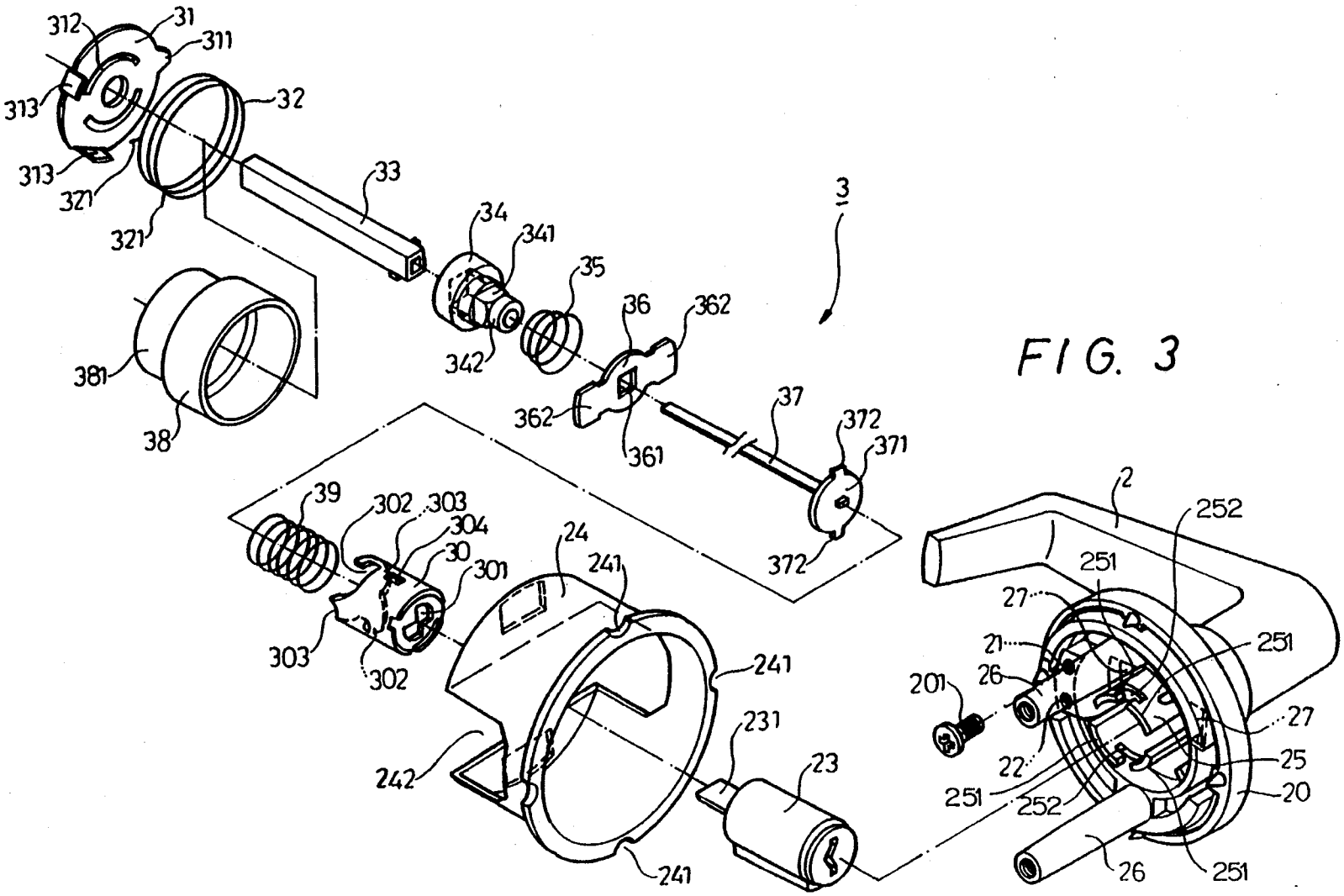
FIG. 3 is a partial exploded view of the door lock.

Referring to the drawings and initially to FIGS. 1, 2 and 3, a door lock in accordance with the present invention comprises generally an inner handle assembly 1 and an outer handle assembly 2 fixed to the door by screws 11, the latch head 120 of the latch 12 can be operated and actuated by the handles 1 and 2 in order to latch and unlatch the door; in which the inner handle assembly 1 is a conventional handle assembly and is not related to the present invention and will not be described in further details. The present invention is related to the outer handle assembly 2.

The outer handle assembly includes a cap 20, a tube 25 rotatably supported in the cap 20, an outer handle 2 fixed to the tube 25 for rotating the tube 25, the tube 25 including a pair of lugs 251 formed in the free end portion thereof, a pair of depressions 27 oppositely formed in the cap 20, two screw holes 21, 22 formed in the cap (FIGS. 2 and 3), a screw 201 engaged with one of the screw holes 21, a pair of extensions 26 extended from the cap 20 and extended inwards of the door. A lock 23 is engaged in the tube 25 (FIG. 1) and includes a protrusion 231 extended therefrom.

A bowl 24 is fixed in the door and includes an opening 242 formed therein for receiving and engaging with the latch 12, and four depressions 241 formed in the outer peripheral portion for engaging with the extensions 26 of the cap 20 such that the bowl 24 is retained in place and can not rotate relative to the cap 20. A coupling means 3 is engaged to the inner handle assembly and received in the bowl 24, best shown in FIG. 1.

The coupling means 3 includes a disc 31 having a projection 311 extended radially outward for engaging with the screw 201, the disc 31 including a pair of curved slots 312 formed therein, the lugs 251 of the tube 25 are extended through the slots 312 of the disc 31 and are bent so as to position the disc 31 and to retain the disc 31 in place such that the disc can be rotated by the handle 2. Engagement of projection 311 and screw 201 forms a stop for the handle. The disc 31 further includes a pair of legs 313 extended laterally outward therefrom, a spring 32 includes two end portions 321 engaged with the legs 313 and with two projections **20*a* on the cap (FIG. 2) so as to bias the disc 31 and thereby spring the handle 2 back to position when it is released after being operated. A barrel 38 includes one half 381 of reduced diameter contacted with the disc 31, the spring 32 is biased between the barrel 38 and the disc 31**.

A shaft 33 includes a square cross section having one end fixed to the inner handle 1 and having a stub 34 fixed on the other end thereof, the stub 34 is received in the one half 381 of the barrel and includes an intermediate section 341 and an outer section 342 formed thereon, in which the intermediate section 341 has a square cross section, and the outer section 342 has a circular cross section. The door latch 12 may, in known manner, have a square aperture received on shaft 33 whereby the latch is actuated by rotation of the shaft. A board 36 includes a square hole 361 formed therein for engaging with either of the sections 341, 342 of the stub 34, in which the board 36 rotates in concert with the stub 34 when the board 36 is engaged with the square and intermediate section 341, and rotates freely when the board 36 is engaged with the circular outer section 342, the board 36 further includes a pair of fins 362 extended outward therefrom and received in the barrel 38, a spring 35 is biased between the stub 34 and the board 36.

A lever 37 extends through the stub 34 and the shaft 33 and coupled to the barrel 13 of the inner handle such that the lever 37 can be rotated by the inner handle 1, the lever 37 includes a disc 371 fixed on one end thereof and having a pair of bulges 372 oppositely extended outward therefrom. A cylinder 30 is rotatably engaged in the tube 25 and includes an opening 301 formed in one end for engaging with the protrusion 231 of the lock 23, a pair of apertures 304 oppositely formed therein for engaging with the bulges 372 of the disc 371 respectively, and two pairs of notches 302, 303 formed in the other end thereof for engaging with the fins 362 of the board 36, in which the fins 362 of the board 36 extend outward beyond the tube 25, best shown in FIG. 1. It is to be noted that each of the notches 302, 303 includes a tapered surface formed therein such that the board 36 can be caused to move longitudinally along the lever 37 to engage with either of the sections 341, 342 of the stub 34 when the fins 362 of the board 36 are slidably engaged with the notches 302, 303. It is further to be noted that the notches 302, 303 include different depth, for example, the notches 302 are deeper than the other pair of notches 303, best shown in FIGS. 4 and 5, such that the board 36 can be maintained to be engaged with either of the sections 341, 342 of the stub 34. A spring 39 is biased between the cylinder 30 and the disc 371 of the lever 37 for biasing the lever 37 to engage with the barrel 13 of the inner handle 1.

As shown in FIG. 1, one end of the shaft 33 is engaged with a square hole of an actuating plate 14,and a tube 15 which is secured to the inner handle 1 extends through a circular slot formed in the actuating plate 14, the shaft 33 may be directly rotated by the inner handle 1. The stub 34 is fixed to the shaft 33 and rotated in concert with the shaft 33. The fins 362 of the board 36 are engaged in the grooves 252 of the outer handle 2 (FIG. 3), such that the board 36 may be directly rotated by the outer handle 2. The board 36 has a square hole 361 for engaging with the intermediate section 341 which has a square cross section.

Figure 4:
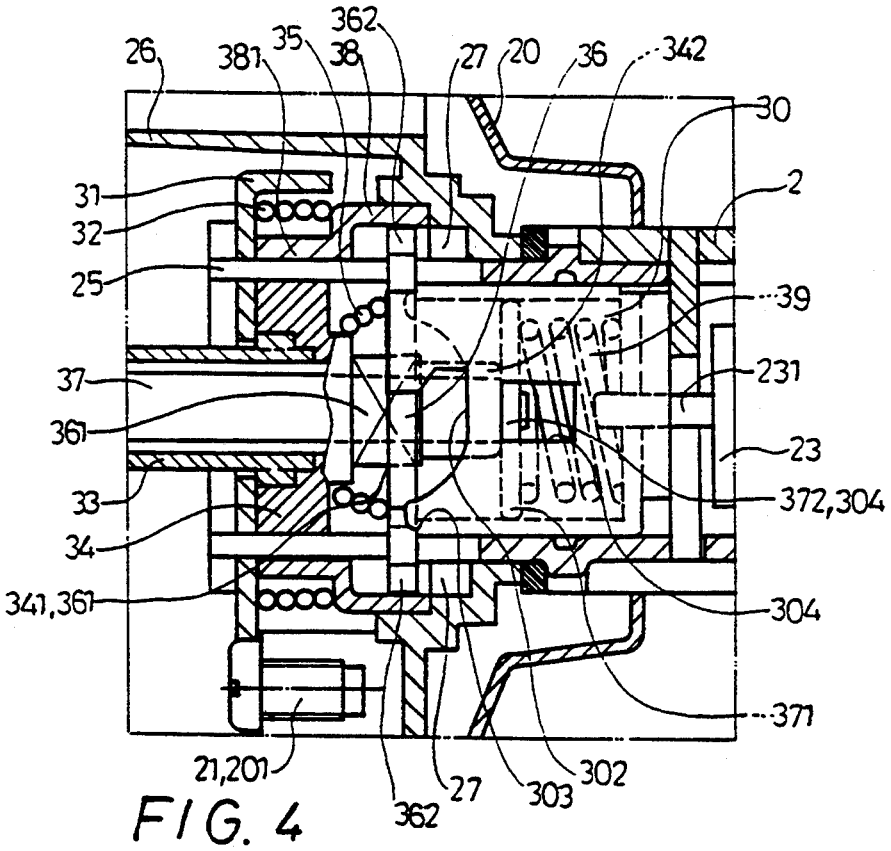
FIGS. 4 and 5 are partially enlarged cross sectional views of FIG. 1, illustrating the operations of the door lock.

As shown in FIGS. 1 and 4, when the fins 362 of the board 36 are engaged with the notches 303, the square hole 361 of the board 36 is caused to engage with the intermediate section 341 of the stub 34 such that the board 36 rotates in concert with the stub 34, whereby, the shaft 33 can be rotated by the inner handle 1, and the board 36 is rotated by the outer handle 2, the stub 34 is thus rotated by the board 36 in order to actuate the latch head 120 of the latch 12. The stub 34 is freely rotatable relative to the board 36 when the square hole 361 is disengaged from the intermediate section 341.

In use, the handle 2 rotates in concert with the tube 25, however, since the tube 25 includes two lugs 251 engaged through the curved slots 312 of the disc 31, the disc 31 includes two legs 313 for engaging with the end portions 321 of the spring 32, rotational movement of the outer handle 2 is limited by engagement between the lugs 251 and the curved slots 312. The outer handle is rotatable freely relative to the stub 34 and the shaft 33 when the board 36 engages with the circular outer section 342. The outer handle 2 is thus not free spinning, the rotational movement of the outer handle 2 is limited as described above.

When the fins 362 of the board 36 are engaged within the recesses 27 of the cap 20, the board may disengage from the intermediate section of the stub 34 such that the stub 34 is freely rotatable relative to the board 36 and such that the shaft 33 and thus the latch head 120 of the latch 12 may not be actuated by the board 36.

Figure 5:
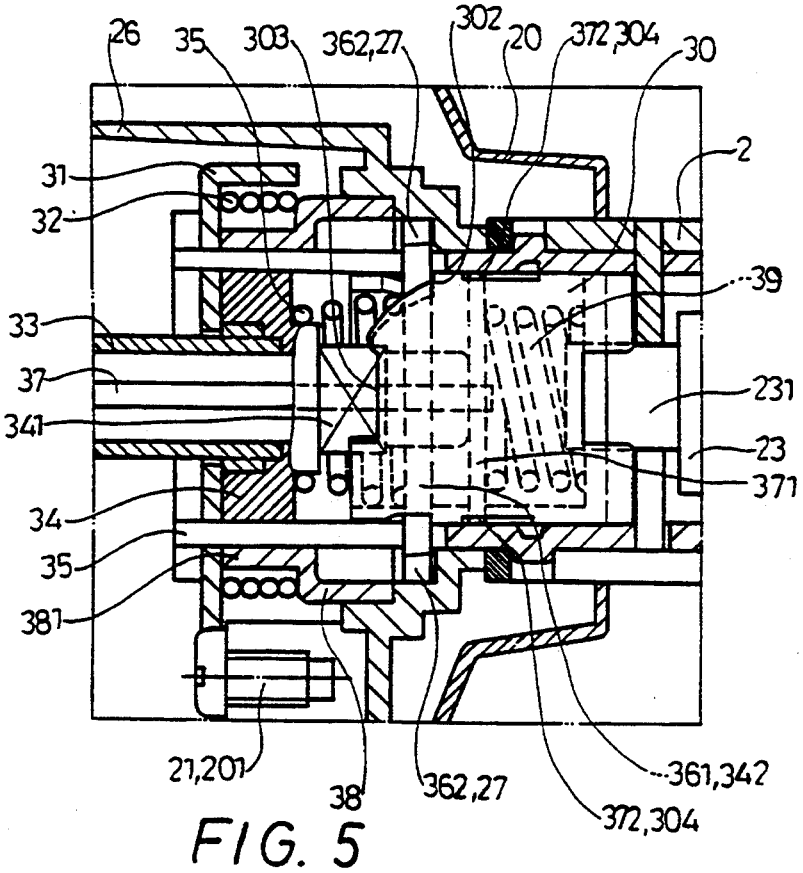

When it is required to lock the door lock, a key is engaged into the lock 23 and rotates the protrusion 231 of the lock 23 such that the cylinder 30 can be rotated; or, when the barrel 13 of the inner handle 1 is rotated, the cylinder 30 can be rotated by the lever 37, after the cylinder 30 is rotated, as shown in FIG. 5, the fins 362 of the board 36 are engaged with the other pair of notches 302 and the board 36 is biased away from the stub 34 to engage with the circular outer section 342 of the stub 34 by the spring 35 until the board 36 is engaged within the depressions 27 of the cap 20. At this moment, the latch can not be actuated by the outer handle 2. It is to be noted that, at this moment, the latch 12 can also be actuated by the inner handle 1 because the shaft 33 can also be rotated by the inner handle 1; whereby, the door can not be opened by the outer handle and can also be opened by the inner handle; such configuration is excellent for handicapped persons.

Accordingly, the door lock in accordance with the present invention can be easily operated by the handicapped persons.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door lock comprising an inner handle and an outer handle assembly, said outer handle assembly comprising a bowl including an opening formed therein, a cap engaged to said bowl, a tube rotatably engaged in said cap and including a free end having a pair of lugs formed thereon, an outer handle fixed to said tube, a lock engaged in said tube and including a protrusion extended therefrom, a cylinder rotatably engaged in said tube and including a first end and a second end, said protrusion of said lock being engaged with said first end of said cylinder in order to rotate said cylinder, said second end of said cylinder including two pairs of notches formed therein, a first pair of said two pairs of notches including a depth deeper than that of a second pair of notches, a shaft of square cross section including a first end coupled to said inner handle and a stub fixed to a second end thereof, said stub including an intermediate section having a square cross section and a circular outer section, a board engaged with either pair of said notches and including a square hole formed therein for engaging with either of said intermediate section or said circular outer section, means biased between said stub and said board, a lever extended through said shaft and including a first disc fixed to a first end thereof and engaged in said cylinder, a second disc rotatably engaged on said shaft and including a pair of slots formed therein for engaging with said lugs of said tube, a barrel engaged on said shaft and including a first end contacted with said second disc, said board being engaged with said intermediate section of said stub when said board is engaged with said second pair of notches such that said shaft and said stub is rotated by said outer handle, and said board being biased to engage with said first pair of notches by said biasing means when said cylinder is rotated by said protrusion of said lock such that said stub is rotated freely relative to said board, said stub being rotated by said shaft and said inner handle.

2. A door lock according to claim 1, wherein said cap includes a depression formed therein, said board is biased to engage with said depression of said cap when said board is biased to engage with said circular outer section of said stub by said biasing means.

3. A door lock according to claim 1, wherein said second disc includes a pair of legs extended laterally therefrom, a spring is engaged in said barrel and including two end portions engaged with said legs of said second disc for biasing said second disc.

4. A door lock according to claim 1, wherein said cap includes two screw holes formed therein, and a screw engaged with one of said screw holes, said second disc includes a projection extended radially outward therefrom for engaging with said screw.

5. A door lock according to claim 1, wherein said cylinder includes a pair of apertures oppositely formed therein, said first disc includes a pair of bulges oppositely extended outward therefrom for engaging with said apertures of said cylinder respectively such that said cylinder and said first disc rotate in concert with each other.

6. A door lock according to claim 1, wherein said board includes a pair of fins oppositely extended outward therefrom for engaging with either pair of said notches.

* * * * *